US006517986B1

(12) United States Patent
Dickerson

(10) Patent No.: US 6,517,986 B1
(45) Date of Patent: Feb. 11, 2003

(54) LOW SILVER RADIOGRAPHIC FILM WITH IMPROVED VISUAL APPEARANCE

(75) Inventor: Robert E. Dickerson, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/994,216

(22) Filed: Nov. 26, 2001

(51) Int. Cl.[7] ..... G03C 5/16

(52) U.S. Cl. ..... 430/139; 430/502; 430/567; 430/966; 430/517

(58) Field of Search ..... 430/139, 567, 430/966, 502, 517

(56) References Cited

U.S. PATENT DOCUMENTS 5,370,977 A * 12/1994 Zeitlow ..... 430/502
5,759,759 A 6/1998 Adin et al.
5,800,976 A 9/1998 Dickerson et al.
5,876,909 A * 3/1999 Hershey et al. ..... 430/567
5,876,913 A 3/1999 Dickerson et al.
6,033,687 A 3/2000 Heinicke et al.
6,033,836 A 3/2000 Fitterman et al.
6,232,058 B1 * 5/2001 Adin et al. ..... 430/966
6,291,153 B1 9/2001 Dickerson
6,391,531 B1 * 5/2002 Dickerson ..... 430/139

* cited by examiner

*Primary Examiner*—Geraldine Letscher
(74) *Attorney, Agent, or Firm*—J. Lanny Tucker

(57) ABSTRACT

Radiographic films exhibit improved visual performance because of the presence of certain colorants that provide more positive a* values without diminishing image tone (b*). Thus, the greenish tint the films may exhibit is reduced. These films provide desired sensitometric properties while they have reduced silver, hydrophilic polymer binder, and hardener coverage on both sides of a transparent support.

20 Claims, No Drawings

LOW SILVER RADIOGRAPHIC FILM WITH IMPROVED VISUAL APPEARANCE

FIELD OF THE INVENTION

This invention is directed to a low silver radiographic film that can be rapidly processed and directly viewed. This film has an improved visual appearance. This invention also provides a film/screen imaging assembly for radiographic purposes, and a method of processing the film to obtain a black-and-white image.

BACKGROUND OF THE INVENTION

Over one hundred years ago, W. C. Roentgen discovered X-radiation by the inadvertent exposure of a silver halide photographic element. In 1913, Eastman Kodak Company introduced its first product specifically intended to be exposed by X-radiation (X-rays). Today, radiographic silver halide films account for the overwhelming majority of medical diagnostic images. Such films provide viewable black-and-white images upon imagewise exposure followed by processing with the suitable wet developing and fixing photochemicals.

In medical radiography an image of a patient's anatomy is produced by exposing the patient to X-rays and recording the pattern of penetrating X-radiation using a radiographic film containing at least one radiation-sensitive silver halide emulsion layer coated on a transparent support. X-radiation can be directly recorded by the emulsion layer where only low levels of exposure are required. Because of the potential harm of exposure to the patient, an efficient approach to reducing patient exposure is to employ one or more phosphor-containing intensifying screens in combination with the radiographic film (usually both in the front and back of the film). An intensifying screen absorbs X-rays and emits longer wavelength electromagnetic radiation that the silver halide emulsions more readily absorb.

Another technique for reducing patient exposure is to coat two silver halide emulsion layers on opposite sides of the film support to form a "dual coated" radiographic film so the film can provide suitable images with less exposure. Of course, a number of commercial products provide assemblies of both dual coated films in combination with two intensifying screens to allow the lowest possible patient exposure to X-rays. Typical arrangements of film and screens are described in considerable detail for example in U.S. Pat. No. 4,803,150 (Dickerson et al.), U.S. Pat. No. 5,021,327 (Bunch et al.), and U.S. Pat. No. 5,576,156 (Dickerson).

Medical radiographic X-radiation films are currently manufactured with several different contrasts in order to meet the diverse radiographic imaging needs. These include high contrast films such as commercially available KODAK TMAT-G Film and low contrast films such as KODAK TMAT-L Film. High contrast films are designed to image anatomy parts that exhibit a narrow range of X-radiation absorbance (such as bones). Medium and low contrast films are designed to image simultaneously several different types of anatomy having different X-radiation absorbance. Radiography of the thoracic cavity (chest) is an example of this need where radiologists need to image the relatively radio-opaque mediastinal area (behind the vertebral column, heart and diaphragm). These areas are quite dense and require greater amounts of X-radiation for desired penetration and imaging on a film. However, it is also desired to image the more radio-transparent lungs. Such imaging requires less X-radiation. KODAK InSight™. IT Film and KODAK InSight™ VHC Film, and the appropriate intensifying screens, are low crossover systems designed to record this wide range of tissue densities with high imaging quality and varying exposure latitude.

During recent years as radiographic films were designed to have high resolution, similar improvements were being achieved in the reduction of processing time. Only a few years ago, processing cycles ("dry to dry") of 90 seconds were the standard in the industry. More recent processing systems such as Eastman Kodak's Rapid Access (RA) system that include forehardened films, special processing chemistry and rapid processing equipment, has reduced the processing cycle to 40 seconds. Because of this trend to faster processing, great demands are placed on the drying of radiographic films since the other processing steps (development, fixing, and washing) are being shortened.

In view of today's needs to reduce health costs, to provide rapid processing, and to minimize the impact of discarded processing chemicals to the environment, even greater demands are placed on medical radiographic films. One approach to meeting those needs is to reduce the level of silver in the films while optimizing the "covering power" of the coated silver halide emulsions.

Previous discoveries have led to useful radiographic films containing reduced amounts of silver as described for example in U.S. Pat. No. 5,876,913 (Dickerson et al.) and U.S. Pat. No. 5,800,976 (Dickerson et al.). The films described in these patents exhibit acceptable image tone as measured using the conventional CIELAB (Commission Internationale de l'Eclairage) color scale.

Images can be identified as "cold" or "warm" depending upon where they fall within the noted color scale as defined by a* and b* values. A "cold" image would be one that is on the bluish side of neutral (that is, a negative b* value) and a "warm" image would be one that is the yellowish of positive b* side of neutral, both measured at a density of 1.0 (for dual-coated films). The a* value is a measure of redness (positive a* value) or greenness (negative a* value). Such measurements can be obtained using known techniques, for example as described by Billmeyer et al., *Principles of Color Technology*, $2^{nd}$ Ed., Wiley & Sons, New York, 1981, Chapter 3.

While known medical radiographic films exhibit the desired b* values (bluish tone), it has been found that when silver coverage is reduced, some of them exhibit an unacceptable green tint, particularly at high densities. It is to this problem that the present invention is addressed. Thus, there is a need to improve visual appearance by reducing or eliminating the undesirable green tint (change in a* value) while maintaining or improving image tone (b* value) in radiographic films having minimal silver.

SUMMARY OF THE INVENTION

The present invention provides a solution to the noted problems with a radiographic silver halide film comprising a transparent support, the film having disposed on each side of the support, one or more hydrophilic colloid layers including at least one silver halide emulsion layer, each of the silver halide emulsion layers comprising silver halide tabular grains that (a) have the same or different composition in each silver halide emulsion layer, (b) account for at least 50% of the total grain projected area within each silver halide emulsion layer, and (c) have an average aspect ratio of greater than 5, the silver coverage on each side of the support being from about 10 to about 14 mg/dm$^2$, each silver halide emulsion layer comprising one or more hydrophilic polymer vehicles at a total coverage of from about 7 to about 20 mg/dm$^2$, the level of hardener on each side of the support being from about 0.3 to about 1 weight % based on total polymer vehicles on that side, the radiographic silver halide film further comprising in one or more of the silver halide emulsion layers, a colorant that is present in an amount sufficient to provide a film a* value of from about −3.2 to about −2.0 at a film b* value of −7.

In preferred embodiments, the present invention provides a radiographic silver halide film comprising a transparent polymeric support, the film having disposed on each side of the support, two or three hydrophilic colloid layers including a single silver halide emulsion layer on each side of the support, each of the silver halide emulsion layers comprising silver halide tabular grains that (a) have the same or different composition in each silver halide emulsion layer, (b) account for at least 80% of the total grain projected area within each silver halide emulsion layer, and (c) have an average aspect ratio of greater than 8, each silver halide emulsion layer being composed of silver halide grains comprising at least 98 mol % bromide and up to 1.5 mol % iodide, both based on total silver, the silver coverage on each side of the support being from about 11 to about 13 mg/dm$^2$, each silver halide emulsion layer comprising one or more hydrophilic polymer vehicles at a total coverage of from about 7 to about 15 mg/dm$^2$, the level of hardener on each side of the support being from about 0.3 to about 0.8 weight % based on total polymer vehicles on that side, the radiographic silver halide film further comprising in one or more of the silver halide emulsion layers, a colorant that is present in an amount sufficient to provide a film a* value of from about −3.0 to about −2.4 at a film b* value of −7, and a film a* value greater than or equal to −5.5 at $D_{min}$.

In more preferred embodiments, the colorant is present in an amount of greater than 0.027 and up to 0.108 mg/dm$^2$. The preferred colorant is represented by the following structure:

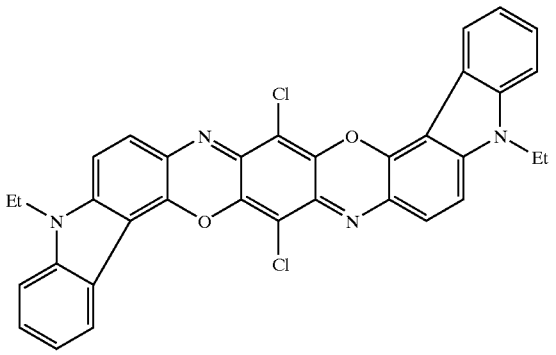

This invention also provides a radiographic imaging assembly comprising a radiographic silver halide film as described above provided in combination with an intensifying screen on either side of the film.

Further, this invention is method comprising contacting the radiographic silver halide film described above, sequentially, with a black-and-white developing composition and a fixing composition, the method being carried out within 90 seconds to provide a black-and-white image.

Thus, the present invention provides a low-silver radiographic film that has improved visual appearance, that is, provides images with less greenish tint at higher image densities. This is evidenced by a film a* value of from about −3.2 to about −2.0 when film b* is kept at −7.0. This change in tinting is obtained by using one or more colorants at sufficient concentrations to modify the overall film a* value in the noted manner. These films also have all of the desired advantages of lower silver coverage such as rapid processing and lower cost. In addition, the hydrophilic polymer vehicle and hardener levels can be reduced, further decreasing processing time and overall costs.

DETAILED DESCRIPTION OF THE INVENTION

The term "contrast" as herein employed indicates the average contrast (also referred to as y) derived from a characteristic curve of a radiographic element using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E(\log_{10}E_2 - \log_{10}E_1)$, $E_1$ and $E_2$ being the exposure levels at the reference points (1) and (2).

"Gamma" is described as the instantaneous rate of change of a D logE sensitometric curve or the contrast at any logE value.

"Peak gamma" is the point of the sensitometric curve where the maximum gamma is achieved.

"Mid-scale contrast" is the slope of the characteristic curve measured between a density of 0.25 above $D_{min}$ to 2.0 above $D_{min}$.

Photographic "speed" refers to the exposure necessary to obtain a density of at least 1.4 plus $D_{min}$.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "tabular grain" is used to define a silver halide grain having two parallel crystal faces that are clearly larger than any remaining crystal faces and having an aspect ratio of at least 2. The term "tabular grain emulsion" refers to a silver halide emulsion in which the tabular grains account for more than 50% of the total grain projected area.

The term "covering power" is used to indicate 100 times the ratio of maximum density to developed silver measured in mg/dm$^2$.

The term "rare earth" is used to refer to elements having an atomic number of 39 or 57 to 71.

The term "front" and "back" refer to locations nearer to and further from, respectively, the source of X-radiation than the support of the film.

The term "dual-coated" is used to define a radiographic film having silver halide emulsion layers disposed on both the frontside and backside of the support.

The noted CIELAB a* and b* values are indications of image tone as viewed by transmission. The values were determined by CIELAB standards for spectra recorded from 400 to 700 nm using D5500 as the standard illuminant. The b* value is a measure of the yellow-blue color balance and the a* value is a measure of the green-red color balance. A difference of at least 0.7b* units or 0.2a* units is considered to be a noticeable difference for a standard observer.

Where two or more silver halide emulsions are disposed on each side of the film support, the "bottom" silver halide emulsion layer is closest to the film support and is defined herein as the "first" or "third" emulsion depending upon which side of the support it resides. The "top" silver halide emulsion layer is farther from the film support and is defined herein as the second or fourth emulsion depending upon which side of the support it resides. Thus, the "first" and "second" silver halide emulsion layers are on one side of the support and the "third" and "fourth" silver halide emulsion layers are on the opposite side of the support.

The radiographic films of this invention include a flexible support having disposed on both sides thereof one or more silver halide emulsion layers and optionally one or more non-radiation sensitive hydrophilic layer(s). The silver halide emulsions in the various layers can be the same or different, and can comprise mixtures of various silver halide emulsions in or more of the layers.

In preferred embodiments, the film has the same single silver halide emulsion layer on both sides of the support. It is also preferred that the films have a protective overcoat (described below) over the silver halide emulsion on each side of the support.

The support can take the form of any conventional radiographic element support that is X-radiation and light transmissive. Useful transparent supports for the films of this invention can be chosen from among those described in *Research Disclosure*, September 1996, Item 38957 XV. Supports and *Research Disclosure*, Vol. 184, August 1979, Item 18431, XII. Film Supports. *Research Disclosure* is published by Kenneth Mason Publications, Ltd., Dudley House, 12 North Street, Emsworth, Hampshire P010 7DQ England.

In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the one or more silver halide emulsion layers on each side of the film support. This layer may be called an interlayer or overcoat, or both.

The silver halide emulsion layers comprise one or more types of silver halide grains responsive to X-radiation. Silver halide grain compositions particularly contemplated include those having at least 80 mol % bromide (preferably at least 98 mol % bromide) based on total silver in a given emulsion layer. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total silver in the emulsion layer) to facilitate more rapid processing. Preferably iodide is from 0 to 1.5 mol % (based on total silver in the emulsion layer) or eliminated entirely from the grains. The silver halide grains in each silver halide emulsion layer can be the same or different, or mixtures of different types of grains.

The silver halide grains useful in this invention can have any desirable morphology including, but not limited to, cubic, octahedral, tetradecahedral, rhombic, orthorhombic, rounded, spherical or other non-tabular morphologies, or be comprised of a mixture of two or more of such morphologies. At least 50% of the total grain projected area within each silver halide emulsion layer is provided by tabular grains. Preferably, substantially all of the grains are tabular grains in each silver halide emulsion layer.

Thus, different silver halide emulsion layers can have silver halide grains of the same or different morphologies as long as at least 50% of the grains are tabular grains. For cubic grains, the grains generally have an ECD of at least 0.8 $\mu$m and less than 3 $\mu$m (preferably from about 0.9 to about 1.4 $\mu$m). The useful ECD values for other non-tabular morphologies would be readily apparent to a skilled artisan in view of the useful ECD values provided for cubic and tabular grains.

Generally, the average ECD of tabular grains used in the films is greater than 0.9 $\mu$m and less than 4.0 $\mu$m, and preferably greater than 1 and less than 3 $\mu$m. Most preferred ECD values are from about 1.6 to about 2.4 $\mu$m. The average thickness of the tabular grains used in this invention is generally at least 0.07 and no more than 0.13 $\mu$m, and preferably at least 0.08 and no more than 0.1 2 $\mu$m.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

Generally, at least 50% (and preferably at least 80%) of the silver halide grain projected area in each silver halide emulsion layer is provided by tabular grains having an average aspect ratio greater than 5, and more preferably greater than 8.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147, 773 (Tsaur et al), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.). The patents to Abbott et al., Fenton et al., Dickerson, and Dickerson et al. are also cited and incorporated herein to show conventional radiographic film features in addition to gelatino-vehicle, high bromide (≧80 mol % bromide based on total silver) tabular grain emulsions and other features useful in the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure*, Item 38957, cited above, Section 1. Emulsion grains and their preparation, subsection D. Grain modifying conditions and adjustments, paragraphs (3), (4), and (5).

A general summary of silver halide emulsions and their preparation is provided by *Research Disclosure*, Item 38957, cited above, Section 1. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof are specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

It may again be desirable that one or more silver halide emulsion layers on each side of the film support include dextran or polyacrylamide as water-soluble polymers that can also enhance covering power. These polymers are generally present in an amount of at least 0.1:1 weight ratio to the gelatino-vehicle (described below), and preferably in an amount of from about 0.3:1 to about 0.5:1 weight ratio to the gelatino-vehicle.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

The silver halide emulsion layers (and other hydrophilic layers) in the radiographic films of this invention are generally fully hardened using one or more conventional hardeners. Thus, the amount of hardener on each side of the support is generally at least 0.3% and up to 1% (preferably up to 0.8%), based on the total dry weight of the polymer vehicles on that side of the support.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

On each side of the radiographic film support, the level of silver is generally at least 10 and no more than 14 mg/dm$^2$, and preferably at least 11 and no more than 13 mg/dm$^2$. In addition, the total coverage of polymer vehicle in each silver halide emulsion layer is generally at least 7 and no more than 20 mg/dm$^2$ and preferably no more than 15 mg/dm$^2$. There will be other polymer vehicle amounts in the various non-silver layers on each side of the support. The amounts of silver and polymer vehicle on the two sides of the support can be the same or different. These amounts refer to dry weights.

The radiographic films generally include a surface protective overcoat on each side of the support that is typically provided for physical protection of the one or more silver halide emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layers and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

An optional feature of the radiographic films of this invention is the presence of one or more microcrystalline particulate dyes in one or more layers, such as silver halide emulsion layers or non-photosensitive hydrophilic underlayers. The presence of such dyes reduces crossover during film use in radiographic assemblies to less than 15%, preferably 10% or less and more preferably 5% or less. The amount in the film to achieve this result will vary on the particular dye(s) used, as well as other factors, but generally the amount of particulate dye is at least 0.5 mg/dm$^2$, and preferably at least 1 mg/dm$^2$, and up to and including 2 mg/dm$^2$.

An essential component of the present invention is the presence of one or more colorants that provide the desired more positive a* value for the film at a given film b* value (for example, −7). In particular the colorants provide a film a* value of from about −3.2 to about −2.0 at a b* value of −7. Preferably, the film a* value is from about −3.0 to about −2.4 at a film b* value of −7. It is desired that the film b* value be as negative as possible, particularly less than −6.9 and preferably less than −7.0.

It is also preferred that the film a* value be equal to or greater than −5.5 at the $D_{min}$ of the image provided by the radiographic film of this invention. Obviously, there is also a desired to keep $D_{min}$ as low as possible so the amount of colorant used may need to be adjusted to meet all of the desired parameters of a more positive film a*, a more negative film b*, and low $D_{min}$.

Useful colorants that provide these results can be readily determined by observing the absorption spectra of the preferred compound noted below and finding compounds that have similar spectra. Mixtures of colorants may be used that provide blended desired absorption spectra. The various colorants can be used in differing amounts depending upon the strength of their spectral absorption.

The most preferred colorant for the practice of this invention is Flexonyl Violet (also known as Colanyl Violet) that has the chemical name diindolo[2,3-c:2',3'-n] triphenodioxazine, 9,19-dichloro-5,15-diethyl-5,15-dihydro- and has the following structure:

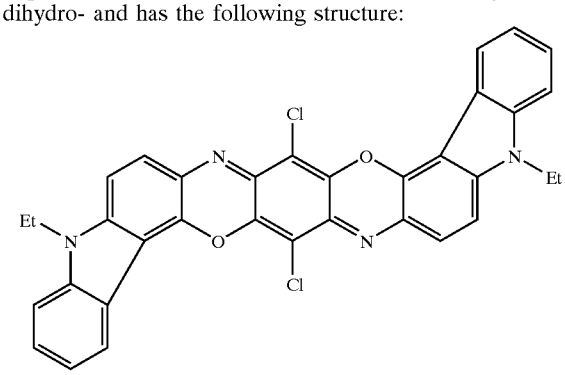

wherein "Et" represents an ethyl group.

The amount of one of more colorants to include in the radiographic films of this invention would be readily apparent to one skilled in the art by carrying out routine experimentation to determine what amount of the colorant will provide the desired shift in film a* value (making it more positive) without appreciably changing the film b* value or by changing b* to be more negative only. In addition, $D_{min}$ must be kept as low as possible (for example, below 0.23). For the preferred colorant (Flexonyl Violet), the general amount in the radiographic film is greater than 0.027 and up to 0.108 mg/dm$^2$, and preferably it is from about 0.04 to about 0.08 mg/dm$^2$.

The radiographic imaging assemblies of the present invention are composed of a radiographic film as described herein and intensifying screens adjacent the front and back of the radiographic film. The screens are typically designed to absorb X-rays and to emit electromagnetic radiation having a wavelength greater than 300 nm. These screens can take any convenient form providing they meet all of the usual requirements for use in radiographic imaging, as described for example in U.S. Pat. No. 5,021,327 (noted above), incorporated herein by reference. A variety of such screens are commercially available from several sources including by not limited to, LANEX™, X-SIGHT™ and InSight™ Skeletal screens available from Eastman Kodak Company. The front and back screens can be appropriately chosen depending upon the type of emissions desired, the photicity desired, whether the films are symmetrical or asymmetrical, film emulsion speeds, and % crossover. A metal screen can also be included if desired.

Exposure and processing of the radiographic films of this invention can be undertaken in any convenient conventional manner. The exposure and processing techniques of U.S. Pat. Nos. 5,021,327 and 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871, 890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

It is particularly desirable that the films of this invention be processed within 90 seconds, and preferably within 45 seconds and at least 20 seconds, including developing, fixing and any washing (or rinsing). Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits can include one or more samples of radiographic film of this invention, one or more intensifying screens used in the radiographic imaging assemblies, and/or one or more suitable processing compositions (for example black-and-white developing and fixing compositions). Preferably, the kit includes all of these components. Alternatively, the radiographic kit can include a radiographic imaging assembly as described herein and one or more of the noted processing compositions.

The following example is provided for illustrative purposes, and is not meant to be limiting in any way.

EXAMPLE

Radiographic Film A (Control)

Radiographic Film A is commercially available KODAK T-MAT G Film. It was a dual coated having silver halide emulsions on both sides of a blue-tinted 178 μm transparent poly(ethylene terephthalate) film support. Each silver halide emulsion layer contained a green-sensitized high aspect ratio tabular grain silver bromide emulsions (wherein "high aspect ratio" is defined by U.S. Pat. No. 4,425,425, noted above) having at least 50 mol % of the total grain projected area being accounted for by tabular grains having a thickness of less than 0.3 μm and an average aspect ratio greater than 8:1. The emulsions were chemically sensitized with sodium thiosulfate, potassium tetrachloroaurate, sodium thiocyanate, and potassium selenocyanate, and spectrally sensitized with 680 mg/Ag mole of anhydro-5,5-dichloro-9-ethyl-3,3'-bis(3-sulfopropyl)oxacarbocyanine hydroxide, followed by 400 mg/Ag mole of potassium iodide.

Radiographic Film A had the following layer arrangement:

Overcoat
Interlayer
Emulsion Layer
Film Support
Emulsion Layer
Interlayer
Overcoat The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| Agl Lippmann emulsion (0.08 μm) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| T-grain emulsion (AgBr 2.9 × 0.10 μm) | 16.1 |
| Gelatin vehicle | 26.3 |
| 4-hydroxy-6-methyl-1,3,3a,7-tetraazaindene | 2.1 g/Ag mole |
| Potassium nitrate | 1.8 |
| 4-hydroxy-6-methyl, 2-methylmercapto-1,3,3A,7-tetraazaindene | 400 mg/Ag mole |
| 2-Mercapto-1,3-benzothiazole | 30 mg/Ag mole |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethylether | 2.4% based on total gelatin in all layers on that side |

Radiographic Film B (Control)

Radiographic Film B was like Film A except that the emulsion layers were prepared from the following formulation:

| Emulsion Layer Formulation | Coverage (mg/dm$^2$) |
|---|---|
| T-grain emulsion (AgBr 2.9 × 0.10 μm) | 11.7 |
| Gelatin vehicle | 7.5 |
| 4-hydroxy-6-methyl-1,3,3a,7-tetraazaindene | 2.1 g/Ag mole |
| Potassium nitrate | 1.8 |
| 4-hydroxy-6-methyl, 2-methylmercapto-1,3,3A,7-tetraazaindene | 400 mg/Ag mole |
| 2-Mercapto-1,3-benzothiazole | 30 mg/Ag mole |

-continued

| Emulsion Layer Formulation | Coverage (mg/dm$^2$) |
|---|---|
| Maleic acid hydrazide | 0.0087 |
| Sorbitol | 0.53 |
| Glycerin | 0.57 |
| Potassium bromide | 0.14 |
| Resorcinol | 0.44 |
| Dextran P | 3.2 |
| Bisvinylsulfonylmethylether | 0.4% based on total gelatin in all layers on that side |

Radiographic Film C (Control)

Film C was like Film B except that Colanyl Violet (0.027 mg/dm$^2$) as added to the silver halide emulsion layer on both sides of the support.

Radiographic Film D (Invention)

Film D was like Film B except that Colanyl Violet (0.054 mg/dm$^2$) as added to the silver halide emulsion layer on both sides of the support.

Radiographic Film E (Invention)

Film E was like Film B except that Colanyl Violet (0.108 mg/dm$^2$) was added to the silver halide emulsion layer on both sides of the support.

Samples of each film were exposed through a graduated density step tablet to a conventional MacBeth sensitometer for 1/50th second using a 500-watt General Electric DMX projector lamp calibrated to 2650° K., filtered with a Corning C4010 filter to simulate a green-emitting X-radiation screen exposure.

Processing of the exposed film samples for sensitometric evaluation was carried out using a processor commercially available under the trademark KODAK RP X-OMAT film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing was carried out using KODAK RP X-OMAT LO Fixer and Replenisher fixing composition (Eastman Kodak Company).

Rapid processing has evolved over the last several years as a way to increase productivity in busy hospitals without compromising image quality or sensitometric response. Where 90-second processing times were once the standard, below 40-second processing is becoming the standard in medical radiography. One such example of a rapid processing system is the commercially available KODAK Rapid Access (RA) processing system that includes a line of X-ray sensitive films available as T-MAT-RA radiographic films that feature fully forehardened emulsions in order to maximize film diffusion rates and minimize film drying. Processing chemistry for this process is also available. As a result of the film being fully forehardened, glutaraldehyde (a common hardening agent) can be removed from the developer solution, resulting in ecological and safety advantages (see KODAK KWIK Developer below). The developer and fixer designed for this system are Kodak X-OMAT RA/30 chemicals. A commercially available processor that allows for the rapid access capability is the Kodak X-OMAT RA 480 processor. This processor is capable of running in 4 different processing cycles. "Extended" cycle is for 160 seconds, and is used for mammography where longer than normal processing results in higher speed and contrast. "Standard" cycle is 82 seconds, "Rapid Cycle" is 55 seconds and "KWIK/RA" cycle is 40 seconds (see KODAK KWIK Developer below). A proposed new "Super KWIK" cycle is intended to be 30 seconds (see KODAK Super KWIK Developer below). The two KWIK cycles (30 & 40 seconds) use the RA/30 chemistries while the longer time cycles use standard RP X-OMAT chemistry. The following Table I shows typical processing times (seconds) for these various processing cycles.

TABLE I

| Cycle | Extended | Standard | Rapid | KWIK | Super KWIK |
|---|---|---|---|---|---|
| Developer | 44.9 | 27.6 | 15.1 | 11.1 | 8.3 |
| Fixer | 37.5 | 18.3 | 12.9 | 9.4 | 7.0 |
| Wash | 30.1 | 15.5 | 10.4 | 7.6 | 5.6 |
| Drying | 47.5 | 21.0 | 16.6 | 12.2 | 9.1 |
| Total | 160.0 | 82.4 | 55 | 40.3 | 30.0 |

The black-and-white developer useful for the KODAK KWIK cycle contained the following components:

| | |
|---|---|
| Hydroquinone | 32 g |
| 4-Hydroxymethyl-4-methyl-1-phenyl-3-pyrazolidone | 6 g |
| Potassium bromide | 2.25 g |
| 5-Methylbenzotriazole | 0.125 g |
| Sodium sulfite | 160 g |
| Water to 1 liter, pH 10.35 | |

The black-and-white developer used for the KODAK Super KWIK cycle contained the following components:

| | |
|---|---|
| Hydroquinone | 30 g |
| 4-Hydroxymethyl-4-methyl-1-phenyl-3-pyrazolidone | 3 g |
| Phenylmercaptotetrazole | 0.02 g |
| 5-Nitroindazole | 0.02 g |
| Glutaraldehyde | 4.42 g |
| Diethylene glycol | 15 g |
| Sodium bicarbonate | 7.5 g |
| VERSENEX 80 | 2.8 g |
| Potassium sulfite | 71.48 g |
| Sodium sulfite | 11.75 g |
| Water to 1 liter, pH 10.6 | |

The sensitometric results are shown in TABLE II below. Optical densities were expressed in terms of diffuse density as measured by an X-rite Model 310TM densitometer that was calibrated to ANSI standard PH 2.19 and was traceable to a National Bureau of Standards calibration step tablet. The characteristic sensitometric curve (density vs. log E) was plotted for each exposed -and processed radiographic film. Photographic speed ("Speed") was measured at a density of 1.4+$D_{min}$. The gamma values were the slopes (derivatives) of those curves.

TABLE II

| Film | Speed | Contrast | $D_{min}$ | $D_{max}$ | b* (at Density of 1.0) | a* (normalized to −7b*) | a* at $D_{min}$ |
|---|---|---|---|---|---|---|---|
| A (Control) | 0 | 2.9 | 0.22 | 3.6 | −6.9 | −2.6 | −5.5 |
| B (Control) | 0 | 2.9 | 0.19 | 3.2 | −6.2 | −3.8 | −6.6 |
| C (Control) | −0.01 | 2.9 | 0.20 | 3.2 | −7 | −4 | −6.3 |
| D (Invention) | −0.02 | 2.8 | 0.20 | 3.2 | −7.5 | −2.6 | −5.3 |
| E (Invention) | −0.04 | 2.9 | 0.22 | 3.2 | −8.3 | −2.0 | −4.1 |

The Control Film A is a commercial radiographic film that has acceptable film a* and b* values but contains relative higher silver coverage as well as conventional amounts of polymer vehicle (gelatin) and hardener. It can be seen from TABLE II that when the commercial film was modified to lower the silver, polymer vehicle (gelatin), and hardener coverage, the film a* value became unacceptably more negative, giving the film a greenish tint that is not desired in the industry.

This problem was corrected by adding Flexonyl Violet to the silver halide emulsion layer on both sides of the transparent support (Films D and E). However, the amount of that colorant had to be greater than 0.027 mg/dm$^2$ as used in Control Film C because the film a* was still too negative.

It is also apparent that Films D and E had acceptable $D_{min}$, $D_{max}$, speed, and contrast is comparison to the commercially available Control A film. The results in TABLE II demonstrate that by careful use of a colorant to control the visual appearance (tint) of the radiographic film (that is, reduce greenish tint), acceptable sensitometric properties can be maintained even when the silver coverage and polymer vehicle and hardener levels are reduced.

The invention has been described in detail with particular reference to preferred embodiments thereof, but it will be understood that variations and modifications can be effected within the spirit and scope of the invention.

I claim:

1. A radiographic silver halide film comprising a transparent support, said film having disposed on each side of said support, one or more hydrophilic colloid layers including at least one silver halide emulsion layer, each of said silver halide emulsion layers comprising silver halide tabular grains that (a) have the same or different composition in each silver halide emulsion layer, (b) account for at least 50% of the total grain projected area within each silver halide emulsion layer, and (c) have an average aspect ratio of greater than 5, the silver coverage on each side of said support being from about 10 to about 14 mg/dm$^2$, each silver halide emulsion layer comprising one or more hydrophilic polymer vehicles at a total coverage of from about 7 to about 20 mg/dm$^2$, the level of hardener on each side of said support being from about 0.3 to about 1 weight % based on total polymer vehicles on that side, said radiographic silver halide film further comprising in one or more of said silver halide emulsion layers, a colorant that is present in an amount sufficient to provide a film a* value of from about −3.2 to about −2.0 at a film b* value of −7.

2. The film of claim 1 wherein said tabular silver halide grains of each silver halide emulsion is composed of at least 80 mol % bromide based on total silver in that emulsion.

3. The film of claim 2 wherein tabular silver halide grains of each silver halide emulsion is composed of at least 98 mol % bromide based on total silver in that emulsion.

4. The film of claim 1 wherein said tabular silver halide grains have an average thickness of from about 0.07 to about 0.13 $\mu$m.

5. The film of claim 1 wherein the silver halide emulsion layers on each side of said support comprise the same silver halide grains, and said film further comprises an overcoat over said silver halide emulsions on each side of said film support.

6. The film of claim 1 comprising a polymer vehicle in each silver halide emulsion layer in a total amount of from about 7 to about 15 mg/dm$^2$, and the level of hardener on each side of said support being from about 0.3 to about 0.8 weight % based on total hardenable polymer vehicles on that side.

7. The film of claim 1 wherein the silver coverage on each side of said support being from about 11 to about 13 mg/dm$^2$.

8. The film of claim 1 wherein said colorant is present in an amount sufficient to provide a film a* value of from about −3.0 to about −2.4 at a film b* value of −7.

9. The film of claim r that exhibits a film a* value greater than or equal to −5.5 at $D_{min}$.

10. The film of claim 1 wherein said colorant is present in an amount of from about 0.027 to about 0.108 mg/dm$^2$.

11. The film of claim 1 wherein said colorant is present in an amount of from about 0.04 to about 0.08 mg/dm$^2$.

12. The film of claim 1 wherein said colorant is represented by the following structure:

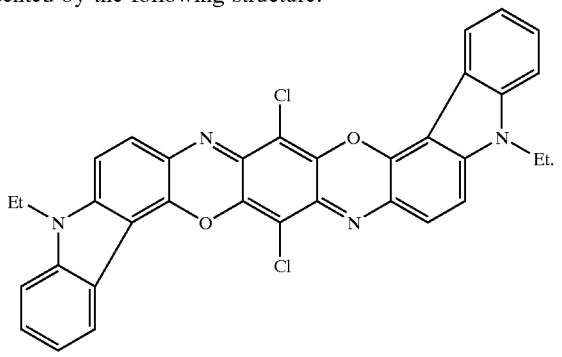

13. A radiographic silver halide film comprising a transparent polymeric support, said film having disposed on each side of said support, two or three hydrophilic colloid layers including a single silver halide emulsion layer on each side of said support, each of said silver halide emulsion layers comprising silver halide tabular grains that (a) have the same or different composition in each silver halide emulsion layer, (b) account for at least 80% of the total grain projected area within each silver halide emulsion layer, and (c) have an average aspect ratio of greater than 8, each silver halide emulsion layer being composed of silver halide grains comprising at least 98 mol % bromide and up to 1.5 mol % iodide, both based on total silver, the silver coverage on each side of said support being from about 11 to about 13 mg/dm$^2$, each silver halide emulsion layer comprising one or more hydrophilic polymer vehicles at a total coverage of from about 7 to about 15 mg/dm$^2$, the level of hardener on each side of said support being from about 0.3 to about 0.8 weight % based on total polymer vehicles on that side, said radiographic silver halide film further comprising in one or more of said silver halide emulsion layers, a colorant that is present in an amount sufficient to provide a film a* value of from about −3.0 to about −2.4 at a film b* value of −7, and a film a* value greater than or equal to −5.5 at $D_{min}$.

14. The film of claim 1 wherein said colorant is present in an amount of greater than 0.027 and less than 0.108 mg/dm$^2$ and is represented by the following structure:

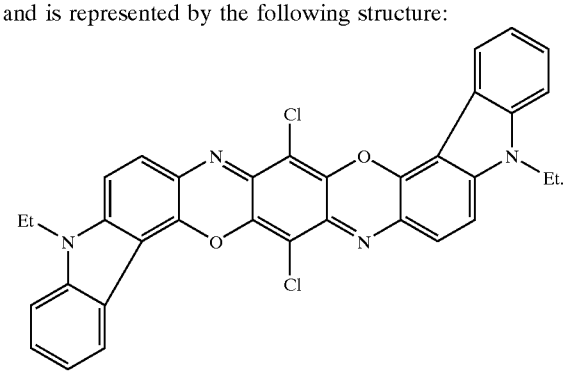

15. A radiographic imaging assembly comprising the radiographic film of claim 1 provided in combination with one or more intensifying screens.

16. A radiographic imaging assembly comprising the radiographic film of claim 13 provided in combination with one or more intensifying screens.

17. A method comprising contacting the radiographic film of claim 1, sequentially, with a black-and-white developing composition and a fixing composition, said method being carried out within 90 seconds to provide a black-and-white image.

18. The method of claim 17 wherein said black-and-white developing composition is free of any photographic film hardeners.

19. The method of claim 17 being carried out for 45 seconds or less.

20. A radiographic kit comprising the radiographic film of claim 1 and one or more of the following:

a) an intensifying screen, b) a black-and-white developing composition, or c) a fixing composition.

* * * * *